US007056637B2

(12) United States Patent
Fields et al.

(10) Patent No.: US 7,056,637 B2
(45) Date of Patent: Jun. 6, 2006

(54) ELECTROPHOTOGRAPHIC TONER WITH UNIFORMLY DISPERSED WAX

(75) Inventors: Robert D. Fields, Rochester, NY (US); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 186 days.

(21) Appl. No.: 10/460,514

(22) Filed: Jun. 12, 2003

(65) Prior Publication Data

US 2003/0232267 A1 Dec. 18, 2003

Related U.S. Application Data

(60) Provisional application No. 60/388,303, filed on Jun. 13, 2002.

(51) Int. Cl.
*G03G 5/00* (2006.01)

(52) U.S. Cl. ..... 430/108.8; 430/110.1; 430/111.4; 430/137.21; 399/222

(58) Field of Classification Search ..... 430/108.8, 430/110.1, 111.4, 137.21; 399/222
See application file for complete search history.

(56) References Cited

U.S. PATENT DOCUMENTS

| | | | | |
|---|---|---|---|---|
| 2,229,513 | A | 1/1941 | Lustig et al. | 217/60 |
| 3,716,630 | A | 2/1973 | Shirk | 423/594 |
| 3,893,935 | A | 7/1975 | Jadwin et al. | 252/62.1 |
| 3,938,992 | A | 2/1976 | Jadwin et al. | 96/1 |
| 3,941,898 | A | 3/1976 | Sadamatsu et al. | 427/18 |
| 4,076,857 | A | 2/1978 | Kasper et al. | 427/18 |
| 4,079,014 | A | 3/1978 | Burness et al. | 252/62.1 |
| 4,160,644 | A | 7/1979 | Ryan | 23/230 |
| 4,323,634 | A | 4/1982 | Jadwin | 430/110 |
| RE31,072 | E | 11/1982 | Jadwin et al. | 430/99 |
| 4,394,430 | A | 7/1983 | Jadwin et al. | 430/110 |
| 4,414,152 | A | 11/1983 | Santilli et al. | 260/185 |
| 4,416,965 | A | 11/1983 | Sandhu et al. | 430/109 |
| 4,430,408 | A | 2/1984 | Sitaramiah | 430/106.6 |
| 4,473,029 | A | 9/1984 | Fritz et al. | 118/657 |
| 4,546,060 | A | 10/1985 | Miskinis et al. | 430/108 |
| 4,624,907 | A | 11/1986 | Niimura et al. | 430/106 |
| 4,683,188 | A | 7/1987 | Suzuki et al. | 430/110 |
| 4,780,553 | A | 10/1988 | Suzuki et al. | 556/26 |
| 4,814,250 | A | 3/1989 | Kwarta et al. | 430/110 |
| 4,828,955 | A | 5/1989 | Kasai et al. | 430/111 |
| 4,834,920 | A | 5/1989 | Bugner et al. | 260/501.15 |
| 4,840,864 | A | 6/1989 | Bugner et al. | 430/110 |
| 4,912,009 | A | 3/1990 | Amering et al. | 430/137 |
| 5,057,392 | A | 10/1991 | McCabe et al. | 430/109 |
| 5,089,547 | A | 2/1992 | McCabe et al. | 524/262 |

(Continued)

FOREIGN PATENT DOCUMENTS

| | | |
|---|---|---|
| EP | 0 003905 | 2/1979 |

(Continued)

OTHER PUBLICATIONS

European Search Report EP 03 01 3180, Sep. 8, 2004.

*Primary Examiner*—Mark A. Chapman
(74) *Attorney, Agent, or Firm*—Carl F. Ruoff

(57) ABSTRACT

Toner particles are described containing at least one toner resin and at least one wax. The wax present in the toner particles has an average domain size of about 1 micron or less. Developer systems, two component and monocomponent, are further described as well development systems and methods for developing an electrostatic image.

24 Claims, 1 Drawing Sheet

U.S. PATENT DOCUMENTS

Figure 1:
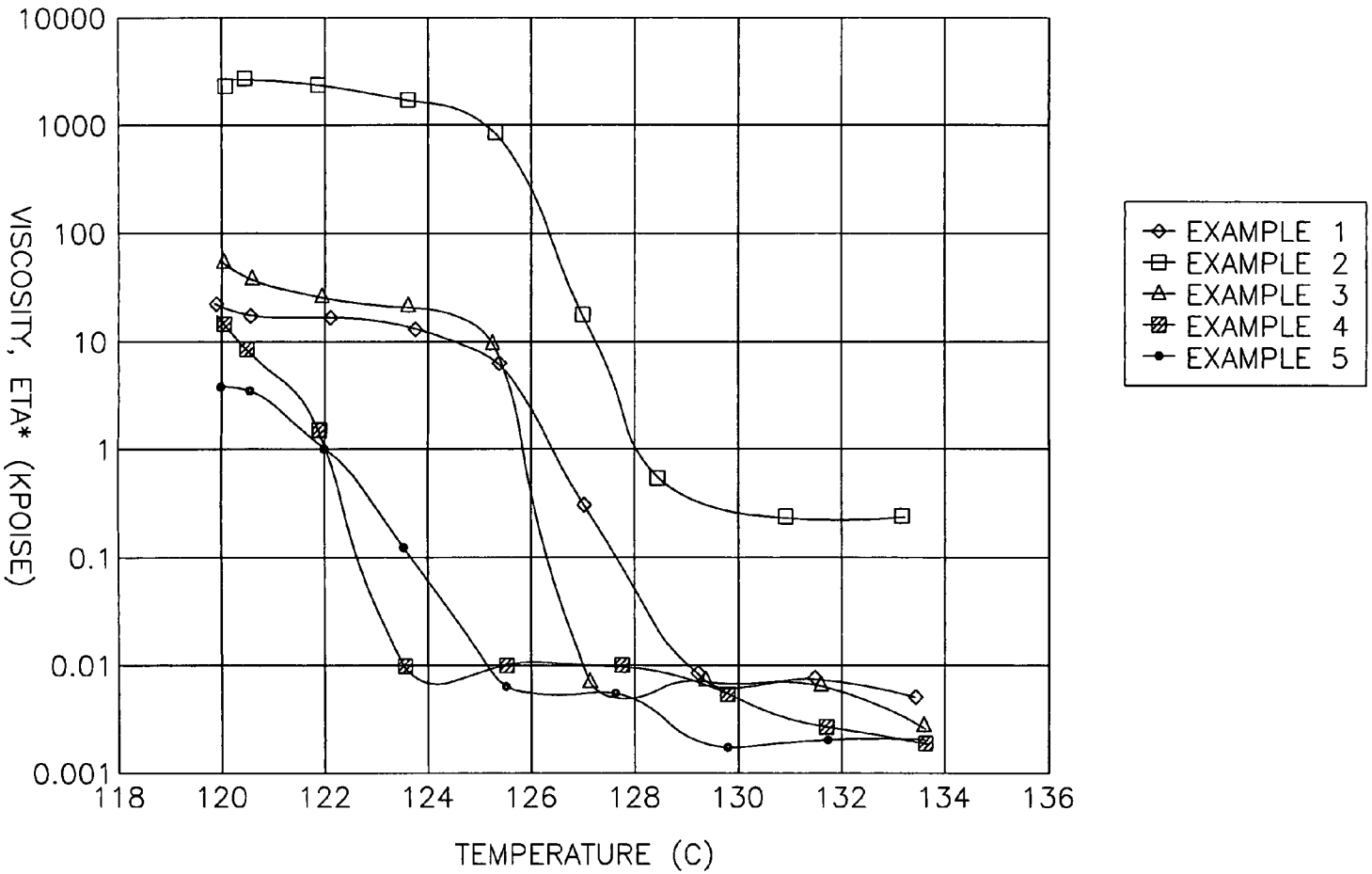

| | | | | |
|---|---|---|---|---|
| 5,102,765 | A | 4/1992 | McCabe et al. | 430/110 |
| 5,112,715 | A | 5/1992 | DeMejo et al. | 430/109 |
| 5,120,631 | A | 6/1992 | Kanbayashi et al. | 430/106 |
| 5,147,747 | A | 9/1992 | Wilson et al. | 430/109 |
| 5,176,978 | A * | 1/1993 | Kumashiro et al. | 430/108.8 |
| 5,283,149 | A | 2/1994 | Tyagi et al. | 430/137 |
| 5,320,926 | A | 6/1994 | Ueda et al. | 430/110 |
| 5,439,772 | A | 8/1995 | Takagi et al. | 430/106.6 |
| 5,486,445 | A | 1/1996 | Van Dusen et al. | 430/110 |
| 5,688,625 | A * | 11/1997 | Bertrand | 430/108.8 |
| 5,714,295 | A | 2/1998 | Wilson et al. | 430/110 |
| 5,780,195 | A | 7/1998 | Nava | 430/110 |
| 6,403,273 | B1 | 6/2002 | Ting et al. | |

FOREIGN PATENT DOCUMENTS

| | | |
|---|---|---|
| EP | 0 908 788 A1 | 4/1999 |
| GB | 1 420 839 | 5/1973 |
| GB | 1 501 065 | 7/1975 |
| JP | 1-217467 | 8/1989 |

* cited by examiner

ELECTROPHOTOGRAPHIC TONER WITH UNIFORMLY DISPERSED WAX

This application claims the benefit under 35 U.S.C. §119 (e) of prior U.S. Provisional Patent Application No. 60/388,303 filed Jun. 13, 2002, which is incorporated in its entirety by reference herein.

BACKGROUND OF THE INVENTION

The present invention relates to electrophotographic toners and developers containing the same. More specifically, the present invention relates to toners containing at least one wax and methods of making toners.

There is a continuing effort to improve toner performance with respect to such properties as fusing quality and image abrasion resistance. Waxes can be used to improve certain properties in a toner system such as release properties. However, the incorporation of a wax into a toner particle can be problematic at times since the wax does not disperse uniformly with the resin or polymer binder that forms a major component of the toner particles as well as the other components of the resin. Toners that have poor uniformity with respect to the dispersion of wax can result in a loss in print image, high triboelectric charge levels which are not within the electrophotographic process window for toning potential, and poor powder flow properties that cause uneven toner replenishment. Furthermore, a toner particle with high wax domains relative to the average wax content may have different triboelectric particles. Also, a particle having large wax domains can be more difficult to fuse.

Accordingly, a toner particle with a uniform wax dispersion would be beneficial in overcoming the above-described problems.

SUMMARY OF THE PRESENT INVENTION

A feature of the present invention is to provide a toner which has a uniformly dispersed wax within the toner.

Another feature of the present invention is to provide a toner having a wax present wherein the wax has a very small average domain size.

A further feature of the present invention is to provide a toner and a developer containing the toner which has a uniform dispersed wax therein such that the above-described disadvantages are overcome.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention relates to a toner containing at least one resin and at least one wax. The wax that is present has an average domain size of about 1 micron or less.

The present invention further relates to a developer containing the above-described toner along with carrier particles. This toner can be used in a two component developer or a monocomponent developer system.

The present invention further relates to a monocomponent developer containing at least one resin, at least one wax, and charging particles, wherein the wax has an average domain size of about 1 micron or less.

The present invention further relates to a method of making the above-described toner formulations, wherein at least one resin and at least one wax are blended together at a temperature where the viscosities of the wax and the resin are closest to each other.

The present invention further relates to a process of preparing the above-described toners wherein at least one wax and at least one resin are blended together, wherein the ratio of the wax melt viscosity/resin melt viscosity is 1/10 or greater.

The present invention further relates to toners made from the processes described above.

It is to be understood that both the foregoing general description and the following detailed description are exemplary and explanatory only and are intended to provide a further explanation of the present invention, as claimed.

BRIEF OF DESCRIPTION OF THE DRAWING

FIG. 1 is a graph showing the melt viscosity of the various waxes used in the examples compared to the melt viscosity of the binder resin over a range of temperatures.

DETAILED DESCRIPTION OF THE PRESENT INVENTION

The present invention relates to toners and developers containing the toners of the present invention. The toner contains at least one resin or polymeric binder and at least one wax. The toners of the present invention are preferably melt-compounded toners. The wax has an average domain size in the toner of about 1 micron or less. The average domain size is the average measured domains or phases of the wax present in the toner particle(s) that are identifiable in the toner particle(s). This can be done by high resolution microscopic techniques. Other ranges include above 0.1 micron to about 1.0, or 0.2 to about 1 micron, or 0.3 to about 1 micron. Other ranges are also possible. More preferably, the wax has an average domain size in the toner of about 0.5 micron or less and more preferably from about 0.05 micron to about 1 micron. Other average domain size ranges include from about 0.10 micron to about 1.0 micron and from about 0.1 micron to about 0.5 micron. When the average domain size of the wax present in the toner is about 1 micron or less, the properties of the overall toner significantly improve with respect to forming a wax that is more free flowing. A more free flowing toner permits a consistent replenishment flow rate to developer stations, uniform flow within a developer station, and more uniform image development.

The present invention further relates to a developer containing the above-described toner. Thus, the present invention relates to developer systems, which are two component developer systems or monocomponent developer systems.

In a two component developer system, the developer system contains the above-described toner along with carrier particles. These carrier particles can be hard or soft carrier particles. With respect to a monocomponent developer system, at least one resin or polymeric binder is present along with at least one wax, and charging particles.

In more detail, the polymeric binder or resin can be any conventional polymeric binder or resin. As further described in detail below, the wax melt viscosity and the binder polymer melt viscosity are at a ratio of 1/10 or greater. The closer the wax melt viscosity is to the binder polymer melt viscosity, the more preferred.

With respect to the wax, the wax can be any conventional wax used with toners. Useful waxes include low molecular weight polypropylene, natural waxes, low molecular weight synthetic polymer waxes, commonly accepted release agents, such as stearic acid and salts thereof, and others.

The wax is preferably present in an amount of from about 0.1 to about 10 wt % and more preferably in an amount of from about 1 to about 6 wt % based on the toner weight. Examples of suitable waxes include, but are not limited to, polyolefin waxes, such as low molecular weight polyethylene, polypropylene, copolymers thereof and mixtures thereof. In more detail, more specific examples are copolymers of ethylene and propylene preferably having a molecular weight of from about 1000 to about 5000 g/mole, particularly a copolymer of ethylene and propylene having a molecular weight of about 1200 g/mole. Additional examples include synthetic low molecular weight polypropylene waxes preferably having a molecular weight from about 3,000 to about 15,000 g/mole, such as a polypropylene wax having a molecular weight of about 4000 g/mole. Other suitable waxes are synthetic polyethylene waxes. Suitable waxes are waxes available from Mitsui Petrochemical, Baker Petrolite, such as Polywax 2000, Polywax 3000, and/or Unicid 700; and waxes from Sanyo Chemical Industries such as Viscol 550P and/or Viscol 660P. Other examples of suitable waxes include waxes such as Licowax PE130 from Clarient. Corporation.

In the present invention, the toner resin can be any conventional polymeric resin or combination of resins typically used in toner formulations using conventional amounts.

The toner particles can include one or more toner resins which can be optionally colored by one or more colorants by compounding the resin(s) with at least one colorant and any other ingredients. Although coloring is optional, normally a colorant is included and can be any of the materials mentioned in *Colour Index*, Volumes I and II, Second Edition, incorporated herein by reference. The toner resin can be selected from a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; 5,780,195 and the like, all incorporated herein by reference. Preferred resin or binder materials include polyesters and styrene-acrylic copolymers. The shape of the toner particles can be any shape, regular or irregular, such as spherical particles, which can be obtained by spray-drying a solution of the toner resin in a solvent. Alternatively, spherical particles can be prepared by the polymer bead swelling techniques, such as those described in European Patent No. 3905 published Sep. 5, 1979, which is incorporated in its entirety by reference herein.

Typically, the amount of toner resin present in the toner formulation is from about 85 to about 95% by weight of the toner formulation.

The toner formulation can optionally contain at least one charge control agent and/or at least one surface treatment agent also known as a spacing agent. Also, the toner formulation can optionally contain at least one colorant and other conventional components typically found in toner formulations. The amount of the agent on the toner particles is an amount sufficient to permit the toner particles to be stripped from the carrier particles in a two component system by the electrostatic forces associated with the charged image or by mechanical forces. Preferred amounts of the spacing agent are from about 0.05 to about 5 weight percent, and more preferably from about 0.1 to about 3 weight percent, and most preferably from about 0.2 to 0.6 weight percent, based on the weight of the toner.

The spacing agent can be applied onto the surfaces of the toner particles by conventional surface treatment techniques such as, but not limited to, conventional powder mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer which is sufficient to keep the spacing agent from agglomerating or at least minimizes agglomeration. Furthermore, when the spacing agent is mixed with the toner particles in order to achieve distribution on the surface of the toner particles, the mixture can be sieved to remove any agglomerated spacing agent or agglomerated toner particles. Other means to separate agglomerated particles can also be used for purposes of the present invention.

The preferred spacing agent is silica, such as those commercially available from Degussa, like R-972, or from Wacker, like H2000. Other suitable spacing agents include, but are not limited to, other inorganic oxide particles and the like. Specific examples include, but are not limited to, titania, alumina, zirconia, and other metal oxides; and also polymer beads preferably less than 1 μm in diameter (more preferably about 0.1 μm), such as acrylic polymers, silicone-based polymers, styrenic polymers, fluoropolymers, copolymers thereof, and mixtures thereof.

The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarboxamidato(2-)], ammonium, sodium, and hydrogen (Organoiron available from Hodogaya Chemical Company Ltd.).

When the toner formulation of the present invention is used in a two-component toner, the carrier particles used in association with the toner formulation can be conventional carrier particles. Thus, the carrier particles can be hard or soft magnetic carrier particles. With a two component developer, the toner concentration of the present invention is preferably present in an amount of from about 1 wt % to about 25 wt %, and more preferably from about 3 wt % to about 12 wt % based on the weight of the developer.

In more detail, the set up of the development system is preferably a digital printer, such as a Heidelberg Digimaster 9110 printer using a development station comprising a non-magnetic, cylindrical shell, a magnetic core, and means for rotating the core and optionally the shell as described, for instance, in detail in U.S. Pat. Nos. 4,473,029 and 4,546,060, both incorporated in their entirety herein by reference. The development systems described in these patents can be adapted for use in the present invention. In more detail, the development systems described in these patents preferably use hard magnetic carrier particles. For instance, the hard magnetic carrier particles can exhibit a coercivity of at least about 300 gauss when magnetically saturated and also exhibit an induced magnetic moment of at least about 20 EMU/gm when in an externally applied field of 1,000 gauss. The magnetic carrier particles can be binder-less carriers or composite carriers. Useful hard magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides such as those having the general formula $MFeO_2$ or $MFe_2O_4$ wherein M represents a mono- or di-valent metal and the iron is in the oxidation state of +3. Preferred ferrites are those containing barium and/or strontium, such as $BaFe_{12}O_{19}$, $SrFe_{12}O_{19}$, and the magnetic ferrites having the formula $MO.6Fe_2O_3$, wherein M is barium, strontium, or lead as disclosed in U.S. Pat. No, 3,716,630 which is incorporated in its entirety by reference herein. The size of the magnetic carrier particles useful in the present invention can vary widely, and preferably have an average particle size of less than 100 microns, and more preferably have an average carrier particle size of from about 5 to about 45 microns.

In a typical manufacturing process, the desired polymeric binder for toner application is produced. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer.

The polymer may be made using a limited coalescence reaction such as the suspension polymerization procedure disclosed in U.S. Pat. No. 4,912,009 to Amering et al., which is incorporated in its entirety by reference herein.

Useful binder polymers (or toner resins) include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Binders of this type are described, for example, in U.S. Reissue Pat. No. 31,072, which is incorporated in its entirety by reference wherein. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful binders.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders.

Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols. Other useful resins include polyester resins, such as by the co-polycondensation polymerization of a carboxylic acid component comprising a carboxylic acid having two or more valencies, an acid anhydride thereof or a lower alkyl ester thereof (e.g., fumaric acid, maleic acid, maleic anhydride, phthalic acid, terephthalic acid, trimellitic acid, or pyromellitic acid), using as a diol component a bisphenol derivative or a substituted compound thereof Specific examples are described in U.S. Pat. Nos. 5,120,631; 4,430,408; and 5,714,295, all incorporated herein by reference, and include propoxylated bisphenol—A fumarate, such as Finetone® 382 ES from Reichold Chemicals, formerly Atlac® 382 ES from ICI Americas Inc.

A useful binder can also be formed from a copolymer of a vinyl aromatic monomer; a second monomer selected from either conjugated diene monomers or acylate monomers such as alkyl acrylate and alkyl methacrylate.

An optional additive for the toner is a colorant. In some cases the magnetic component, if present, acts as a colorant negating the need for a separate colorant. Suitable dyes and pigments are disclosed, for example, in U.S. Reissue Pat. No. 31,072 and in U.S. Pat. Nos. 4,160,644; 4,416,965; 4,414,152; and 2,229,513, all incorporated in their entireties by reference herein. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent. The toner formulations can also contain one or more other additives of the type used in conventional toners, including magnetic pigments, colorants, leveling agents, surfactants, stabilizers, and the like.

The remaining components of toner particles as well as the hard magnetic carrier particles can be conventional ingredients. For instance, various resin materials can be optionally used as a coating on the hard magnetic carrier particles, such as fluorocarbon polymers like poly (tetrafluoro ethylene), poly(vinylidene fluoride) and poly(vinylidene fluoride-co-tetrafluoroethlyene). Examples of suitable resin materials for the carrier particles include, but are not limited to, silicone resin, fluoropolymers, polyacrylics, polymethacrylics, copolymers thereof, and mixtures thereof, other commercially available coated carriers, and the like.

When the toner formulation of the present invention is used in a single component toner system, the toner formulation has present charging particles as well, such as negatively charging particles. The amount of the charging particles for the single component optional system are conventional amounts. When a single component system is used, preferably the charging particles are at least one type of magnetic additive or material, such as soft iron oxide which is dispersed in the toner. Examples of useful charging particles include mixed oxides of iron, iron silicon alloys, iron aluminum, iron aluminum silicon, nickel iron molybdenum, chromium iron, iron nickel copper, iron cobalt, oxides of iron and magnetite. Other suitable magnetic materials that can be present in the toner include, but are not limited to, magnetic material containing acicular magnetites, cubical magnetites, and polyhedral magnetites. A useful soft iron oxide is TMB1120 from Magnox Inc.

The toner formulations of the present invention can also be used in magnetic image character recognition (MICR). In such an application, the amount of the magnetic material in the toner particles of the present invention can be any amount sufficient to preferably meet commercial needs, such as providing a sufficient signal strength for the toners developed as an image. Preferably, the amount of magnetic loading in the toner compositions is from about 40% to about 50% by weight of the toner particles, and more preferably from about 42% to about 45% by weight of the toner particles though other amounts can be used. The toner preferably comprises, based on the weight of the toner, from about 40 to about 60 wt % polymer; from about 30 to about 55 wt % magnetic additive or material; optionally from about 1 to about 5 wt % release agent; and the preferred concentrations of silicon dioxide described above, all based on the weight of the toner.

The present invention further relates to methods of forming images using the toners and developers of the present invention. Generally, the method includes forming an electrostatic latent image on a surface of an electrophotographic element and developing the image by contacting the latent image with the toner/developer of the present invention.

The present invention further relates to the use of the above-described development system in developing electrostatic images with the toner of the present invention. The method involves contacting an electrostatic image with the toner of the present invention. For example, the method involves developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer composition is preferably used. The dry developer composition contains charged toner particles and oppositely charged carrier particles. The carrier particles are preferably a hard magnetic material exhibiting a coercivity of at least about 300 gauss when magnetically saturated and also exhibit an induced magnetic moment of at least about 20 EMU/gm when in an externally applied field of 1,000 gauss. The carrier particles have a sufficient magnetic moment to prevent the carrier particle from transferring to the electrostatic image. The various methods described in U.S. Pat. Nos. 4,473,029 and 4,546,060 can be used in the present invention using the toner of the present invention in the manners described herein, and these patents are incorporated in their entirety by reference herein.

In forming the toner formulations of the present invention, preferably, the toner resin and the wax are blended together preferably at a temperature where the viscosities of each component are relatively at their closest to each other. More preferably, the wax melt viscosity and the toner resin melt viscosity (and optionally including the other components of the toner, except the wax) are at a ratio of 1/10 or greater and more preferably, 2/10 to 10/10 and even more preferably 4/10 to 10/10 or greater. As shown in the examples, the wax and the toner resin can be blended at a variety of temperatures. However, it is preferred that the blending is at a temperature where the melt viscosities of each main component, namely the toner resin and the wax are at their closest as shown in FIG. 1. By producing the toner formulation using the above-described method of melt viscosities, a toner particle can be formed which has a favorable aerated density which is high and the average domain size of the wax in the toner particle is small such as on the order of about 1 micron or less as described above. Accordingly, one embodiment of the present invention involves forming toner particles using one or more of the above-described processes. Viscosity ranges of the overall melt compounded toner is from about 200 to about 500 kP. Other ranges or amounts below and above these amounts can be achieved. By using the process of the present invention, a wax and/or toner resin can be chosen such that the melt viscosities are relatively close to each other or are at the viscosity ratio described above.

The present invention will be further clarified by the following examples, which are intended to be exemplary of the present invention.

EXAMPLE

In the following examples, the wax levels of various polyethylene waxes were used in combination with a binder polymer which was a styrene acrylic binder. In the examples, the toner also contained carbon black and an organic charge agent although these ingredients were not necessary. The carbon black was present in a concentration of 7 pph of base polymer and the charge agent was present in a range of from 1.0 to 2.5 pph of base polymer. The components were melt compounded in a twin screw continuous compounding extruder wherein the binder polymer had a melt viscosity of about 250 to 450K poise measured at 120° C. in a parallel plate viscometer at 1 radian/sec. The viscosity of the various polyethylene waxes used in the examples was also measured and shown in FIG. 1. As can be seen in FIG. 1, the melt viscosity of all of the waxes was evaluated in these examples and was less than the binder resin.

The melt-compounded toner was fine ground in a jet mill and then air classified to remove fine particles. The final toner particle size distribution had a volumetric mean size of 11.5 microns and a particle size distribution with, calculated from the ratio of D50/D16 of the relative number distribution, value of 1.3.

TABLE 1

| Example | Manufacturer | Wax Type | Wax Level (pph) | Aerated density, gm/cm3 |
|---|---|---|---|---|
| 1 | Baker Petrolite | Polywax 3000 | 2.0 | 0.238 |
| 2 | Clariant | Licowax PE 190 | 2.0 | 0.300 |
| 3 | Clariant | Licowax PE 130 | 2.0 | 0.253 |
| 4 | Baker Petrolite | Ceramer 5005 | 2.0 | 0.306 |
| 5 | Baker Petrolite | Polywax 2000 | 2.0 | 0.182 |
| 6 | no wax | none | None | 0.340 |

TABLE 2

| Toner Charge Level | | | |
|---|---|---|---|
| | | Q/m of preconditioned developers, uC/gm | |
| Example | | 2 minutes | 10 minutes |
| 1 | Polywax 3000 | −20 | −32 |
| 2 | Licowax PE 190 | −19 | −34 |
| 3 | Licowax PE 130 | −25 | −34 |
| 4 | Ceramer 5005 | −33 | −43 |
| 5 | Polywax 2000 | −22 | −31 |
| 6 | None | −17 | −28 |

The toners made with uniform and finely dispersed wax dispersions were less cohesive and more free flowing than toners made with poorly dispersed waxes. The advantages of achieving such properties are a consistent replenishment flow rate to developer stations, uniform flow within a developer station, and more uniform image development. The toner aerated density was a measure of the cohesiveness of a powder. Aerated bulk density was measured with a Hosakawa Powder Tester. This test measured the density of a toner sample that was allowed to free flow and settle into volumetric claibrated cups. The higher aerated density values indicated that the powder is more free flowing and that the toner particles can flow freely past each other and settle into a more densely packed powder. The toner with poorly dispersed waxes had larger wax domains which is undesirable and leads to particles adhering to each other resulting in poor powder flow and low aerated density.

When these toners were used in a printer, the toners with the higher aerated bulk density gave less contamination of the fuser system than toners with a low aerated density. The non-uniform wax dispersion results in some particles being higher in wax content than the bulk average. These particles did not adhere well to paper and can accumulate on rollers in a heat-pressure fusing system. Toner contamination of the fusing system can also cause image defects, such as dark spots, streaks, or a poorly fused image.

As can be seen from the above results, toners made with high viscosity waxes, Examples 1, 2, 3, and 4 had powder flow properties close to the control toner (Example 6). Example 5 made with the lowest viscosity wax also had the lowest bulk aerated density and was the most cohesive powder. Toner charge was also measured on a sample toner from a developer made with hard ferrite, silicone coated carrier at 10 wt % toner concentration. The developer was first made at 20% by weight toner concentration, mixed for 1 hour on a magnetic agitator to simulate developer station operation, and then the toner was electrostatically stripped from the developer. This process simulated triboelectric equilibration of the developer. A developer was then made at 10% by weight toner concentration with the equilibrated carrier and the toner triboelectric charge measured after 2 and 10 minutes of agitation with a MECCA device. The toner Q/m ratio can be measured in a MECCA device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture is placed on the bottom metal plate. The sample is then subjected for thirty (30) seconds to a 60 Hz magnetic field and potential of 2000 V across the plates, which causes developer agitation. The toner particles are released from the carrier particles under the combined influence of the magnetic and electric fields and are attracted to and thereby deposit on the upper electrode plate, while the magnetic carrier particles are held on the lower plate. An electrometer measures the accumulated charge of the toner on the upper plate. The toner Q/m ratio in terms of microcoulombs per gram (μC/g) is calculated by dividing the accumulated charge by the mass of the deposited toner taken from the upper plate.

The addition of an olefin wax to a negative charging toner made the toner charge at higher negative values. The toner examples with wax, Examples 1–4, all charged more negatively than the control toner with no wax. The toner with the lowest viscosity wax, Example 4, had the highest negative charging level. Wax effect on toner charge level was the least with the examples that had the most viscous waxes, Examples 1 and 2.

Thus, viscosities of the waxes which were closest to the binder polymer showed the most beneficial properties overall.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. Toner particles comprising a composition consisting of at least one toner resin melt-compounded with at least one wax, wherein said at least one wax has an average domain size in the toner particles of about 1 micron or less, and wherein said toner particles are negative charging toner particles.

2. The toner particles of claim 1, wherein said average domain size is from about 0.1 to about 1 micron.

3. The toner particles of claim 1, wherein said average domain size is from about 0.1 to about 0.5 micron.

4. The toner particles of claim 1, wherein said average domain size is from about 0.5 micron or less.

5. The toner particles of claim 1, wherein said average domain size is from about 0.05 to about 1 micron.

6. The toner particles of claim 1, further comprising at least one surface treatment agent.

7. The toner particles of claim 6, wherein said surface treatment agent comprises silica.

8. The toner particles of claim 1, further comprising at least one colorant, at least one charge agent, at least one surface agent, or combinations thereof.

9. The toner particles of claim 1, wherein said toner resin comprises cross-linked styrene acrylate or cross-linked polyester or derivatives thereof.

10. The toner particles of claim 1, wherein said wax comprises polyethylene.

11. The toner particles of claim 1, wherein said wax comprises at least one polyolefin wax.

12. A two component developer comprising the toner particles of claim 1 and carrier particles.

13. The two component developer of claim 12, wherein said carrier particles are hard carrier particles.

14. A monocomponent developer comprising the toner particles of claim 1, wherein said toner particles further comprise charging particles present in said toner particles.

15. A development system for toner comprising:

a supply of dry developer mixture comprising the toner particles of claim 1 and hard magnetic carrier particles;

a non-magnetic, cylindrical shell for transporting the developer from said supply to a development zone, wherein said shell is rotatable or stationary;

a rotating magnetic core of a pre-selected magnetic field strength;

means for rotating at least said magnetic core to provide for the transport of said toner particles from said shell to an electrostatic image.

16. The development system of claim 15, wherein said toner particles have a spacing agent on the surface of said toner particles.

17. The development system of claim 16, wherein said spacing agent comprises silica.

18. A method for developing an electrostatic image with the toner particles of claim 1 comprising developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which is rotating or stationary, and controlling the directions and speeds of the core and optionally the shell rotations so that developer flows through the development zone in a direction co-current with the image member movement, wherein said developer comprises charged toner particles of claim 1 and oppositely charged hard magnetic carrier particles.

19. The toner particles of claim 1, wherein said toner resin comprises a polyester.

20. The toner particles of claim 1, wherein said toner resin comprises a polyester synthesized from a bisphenol diol and a polycarboxylic acid.

21. A method of making the toner particles of claim 1 comprising melt-compounding at least one toner resin and at least one wax together wherein during melt-compounding, the melt viscosity of said wax and the melt viscosity of said toner resin are at a ratio of 1/10 or greater.

22. The method of claim 21, wherein said ratio is from about 1/10 to about 10/10.

23. The method of claim 21, wherein said ratio is from about 4/10 to about 10/10.

24. A method of making the toner particles of claim 1 comprising melt-compounding at least one toner resin and at least one wax together at a temperature such that the melt viscosities of said wax and said toner resin are at the closest to each other.

* * * * *